US012252837B2

(12) United States Patent
Reeves et al.

(10) Patent No.: US 12,252,837 B2
(45) Date of Patent: Mar. 18, 2025

(54) DRYER APPLIANCE LOAD DETECTION

(71) Applicant: Haier US Appliance Solutions, Inc., Wilmington, DE (US)

(72) Inventors: Joshua Reeves, Louisville, KY (US); Ionelia Silvia Prajescu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 623 days.

(21) Appl. No.: 17/568,894

(22) Filed: Jan. 5, 2022

(65) Prior Publication Data

US 2023/0212813 A1 Jul. 6, 2023

(51) Int. Cl.

| | |
|---|---|
| ***D06F 58/38*** | (2020.01) |
| ***D06F 103/08*** | (2020.01) |
| ***D06F 103/32*** | (2020.01) |
| ***D06F 105/56*** | (2020.01) |
| ***D06F 105/62*** | (2020.01) |

(52) U.S. Cl.

CPC ..... *D06F 58/38* (2020.02); *D06F 2103/08* (2020.02); *D06F 2103/32* (2020.02); *D06F 2105/56* (2020.02); *D06F 2105/62* (2020.02)

(58) Field of Classification Search

CPC .. D06F 58/38; D06F 2103/08; D06F 2103/32; D06F 2105/56; D06F 2105/62

USPC ..... 34/527, 595–610

See application file for complete search history.

(56) References Cited

U.S. PATENT DOCUMENTS

| | | | | |
|---|---|---|---|---|
| 4,086,707 | A * | 5/1978 | Bochan | D06F 58/48 192/82 T |
| 5,570,520 | A | 11/1996 | Huffington | |
| 6,122,840 | A | 9/2000 | Chbat | |
| 6,819,255 | B2 | 11/2004 | Chernetski | |
| 7,528,503 | B2 * | 5/2009 | Rognli | G06Q 30/0207 307/62 |
| 7,594,343 | B2 * | 9/2009 | Woerdehoff | D06F 58/46 34/562 |
| 8,104,191 | B2 * | 1/2012 | Ricklefs | D06F 58/203 68/5 R |
| 8,256,139 | B2 * | 9/2012 | Morrison | D06F 58/50 68/18 R |
| 8,375,599 | B2 * | 2/2013 | Dey | D06F 58/38 68/12.27 |
| 8,555,522 | B2 | 10/2013 | Bellinger | |
| 8,707,580 | B2 | 4/2014 | Hopkins | |

(Continued)

FOREIGN PATENT DOCUMENTS

| | | | | |
|---|---|---|---|---|
| AU | 2016393737 | A1 * | 8/2018 | D06F 29/005 |
| CA | 2345631 | A1 | 11/2001 | |

(Continued)

*Primary Examiner* — Stephen M Gravini

(74) *Attorney, Agent, or Firm* — Dority & Manning, P.A.

(57) ABSTRACT

A method of operating a dryer appliance includes activating a heating system of the dryer appliance and tracking an energy output of the heating system. The method also includes determining a load score of a load of articles to be dried in the dryer appliance based on the tracked energy output and determining a termination criterion for a dry operation of the dryer appliance based on the load score. The method further includes performing the dry operation in the dryer appliance and terminating the dry operation when the determined termination criterion is reached.

18 Claims, 4 Drawing Sheets

(56) References Cited

U.S. PATENT DOCUMENTS

| | | | | |
|---|---|---|---|---|
| 8,910,397 | B2 | 12/2014 | Bellinetto | |
| 9,580,860 | B2 | 2/2017 | Bellinger | |
| 9,888,452 | B2 * | 2/2018 | Logan | G05B 19/0428 |
| 10,087,565 | B2 * | 10/2018 | Janke | D06F 33/36 |
| 10,619,286 | B2 | 4/2020 | Pesavento | |
| 10,793,996 | B2 * | 10/2020 | Seo | D06F 58/38 |
| 10,988,883 | B2 * | 4/2021 | Altinier | D06F 34/18 |
| 2011/0153104 | A1 | 6/2011 | Drake | |
| 2023/0175193 | A1 * | 6/2023 | Reeves | D06F 34/18 34/527 |
| 2023/0212813 | A1 * | 7/2023 | Reeves | D06F 34/18 34/527 |
| 2024/0184719 | A1 * | 6/2024 | Luciano | H02J 13/00026 |

FOREIGN PATENT DOCUMENTS

| | | | | |
|---|---|---|---|---|
| EP | 2927367 | A1 * | 10/2015 | D06F 58/28 |
| EP | 2927366 | B1 | 9/2020 | |
| WO | WO-2007014146 | A2 * | 2/2007 | G06Q 30/0207 |
| WO | WO2014082825 | A1 | 6/2014 | |

* cited by examiner

DRYER APPLIANCE LOAD DETECTION

FIELD OF THE INVENTION

The present subject matter relates generally to dryer appliances, and more particularly to dryer appliances configured for detecting characteristics of a load of articles therein, and related methods.

BACKGROUND OF THE INVENTION

A conventional appliance for drying articles such as a clothes dryer (or laundry dryer) for drying clothing articles typically includes a cabinet having a rotating drum for tumbling clothes and laundry articles therein. One or more heating elements, for example electric heating elements, heat air prior to the air entering the drum, and the warm air is circulated through the drum as the clothes are tumbled to remove moisture from laundry articles in the drum.

Typically, dryer appliances estimate cycle completion for a given sensor-based cycle in response to sensor data such as temperature and/or humidity. However, such estimates typically rely on standardized termination criteria, e.g., a default end temperature and/or humidity which may be a factory preset value, such as for all similar models of dryer appliance, and thus are not always accurate across different loads and across multiple machines with varying tolerances and installation conditions.

Accordingly, a dryer appliance having improved load size detection would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dryer appliance is provided. The dryer appliance includes a cabinet with a drum rotatably mounted within the cabinet. The drum defines a chamber for the receipt of articles for drying. The dryer appliance also includes a heating system fluidly coupled to the drum whereby heated air flows from the heating system to the chamber of the drum for drying of articles within the chamber. The method includes activating the heating system of the dryer appliance and tracking an energy output of the heating system. The method also includes determining a load score of a load of articles to be dried in the dryer appliance based on the tracked energy output and determining a termination criterion for a dry operation of the dryer appliance based on the load score. The method further includes performing the dry operation in the dryer appliance and terminating the dry operation when the determined termination criterion is reached.

In another exemplary aspect of the present disclosure, a dryer appliance is provided. The dryer appliance includes a cabinet with a drum rotatably mounted within the cabinet. The drum defines a chamber for the receipt of articles for drying. The dryer appliance also includes a heating system fluidly coupled to the drum whereby heated air flows from the heating system to the chamber of the drum for drying of articles within the chamber. The dryer appliance further includes a controller. The controller is configured for activating the heating system of the dryer appliance and tracking an energy output of the heating system. The controller is also configured for determining a load score of a load of articles to be dried in the dryer appliance based on the tracked energy output and determining a termination criterion for a dry operation of the dryer appliance based on the load score. The controller is further configured for performing the dry operation in the dryer appliance and terminating the dry operation when the determined termination criterion is reached.

These and other features, aspects, and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
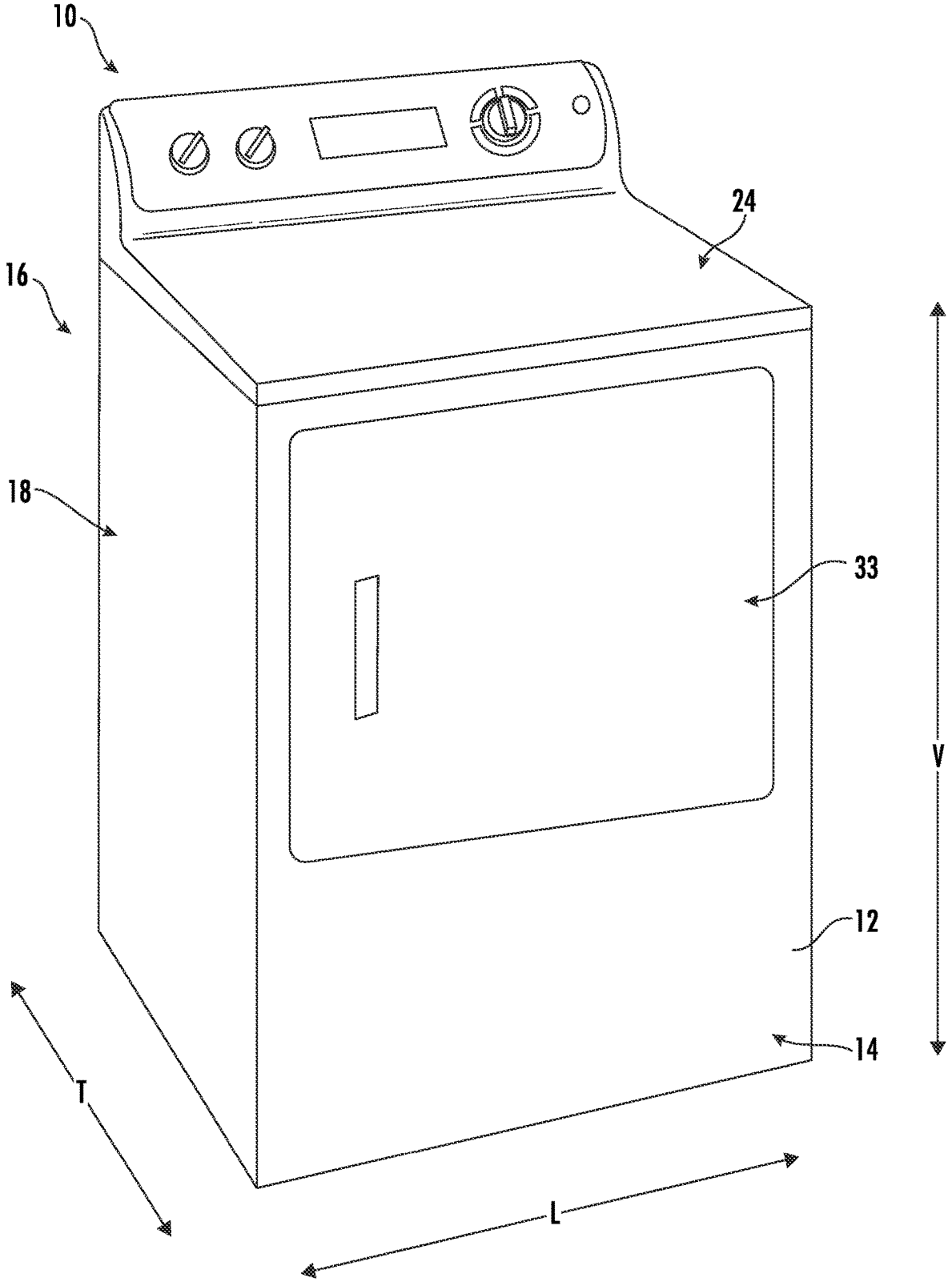
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
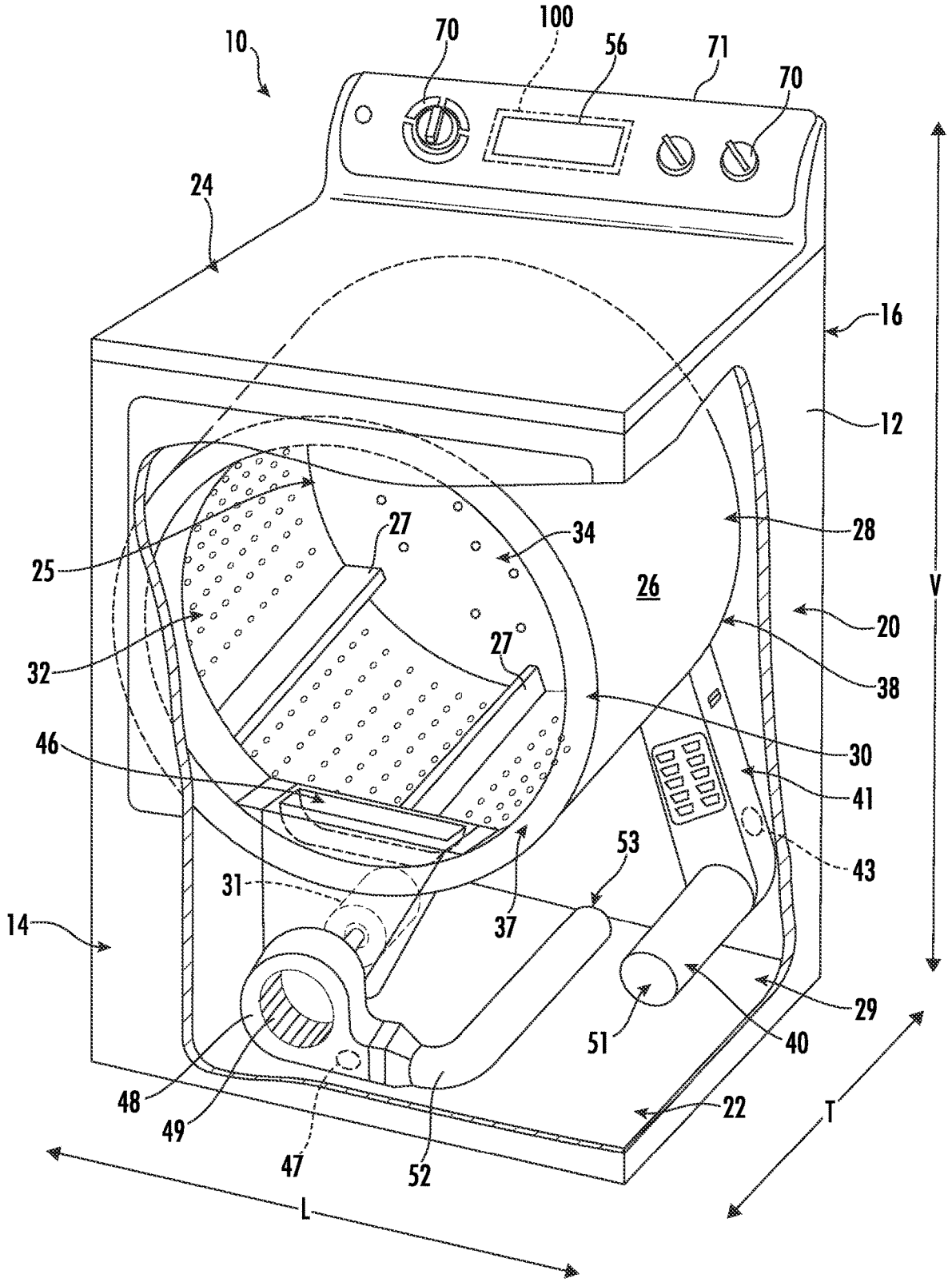
FIG. 2 provides a perspective view of the example dryer appliance of FIG. 1 with portions of a cabinet of the dryer appliance removed to reveal certain components of the dryer appliance.

Turning now to the figures, FIG. 1 provides a perspective view of dryer appliance 10 according to one or more exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Drum 26 includes a rear wall 34 rotatably supported within main housing 12 by a suitable fixed bearing. Rear wall 34 can be fixed or can be rotatable. Rear wall 34 may include, for instance, a plurality of holes that receive hot air that has been heated by a heating assembly or system 40, as will be described further below. Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative example embodiments, dryer appliance 10 may include an additional motor (not shown) for rotating fan 49 of air handler 48 independently of drum 26.

Drum 26 is configured to receive heated air that has been heated by a heating assembly 40, e.g., via holes in the rear wall 34 as mentioned above, in order to dry damp articles disposed within chamber 25 of drum 26. For example, heating assembly 40 may include a heating element (not shown), such as a gas burner, an electrical resistance heating element, or heat pump, for heating air. In particular embodiments, the heating assembly 40 may be or include an electric heater comprising a plurality of electric resistance heating elements with a plurality of relays for selectively providing or obstructing electrical power to the heating elements, such as two relays which permit operation of the heating assembly 40 at various power levels, such as 50% power when only one of two relays is closed. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air may accumulate moisture, e.g., from damp clothing disposed within chamber 25. In turn, air handler 48 draws moisture-saturated air through a screen filter (not shown) which traps lint particles. Such moisture-statured air then enters an exit duct 46 and is passed through air handler 48 to an exhaust duct 52. From exhaust duct 52, such moisture-statured air passes out of dryer appliance 10 through a vent 53 defined by cabinet 12. After the clothing articles have been dried, they are removed from the drum 26 via opening 32. A door 33 (FIG. 1) provides for closing or accessing drum 26 through opening 32. The door 33 may be movable between an open position and a closed position, the open position for access to the chamber 25 defined in the drum 26, and the closed position for sealingly enclosing the chamber 25 defined in the drum 26.

In some embodiments, one or more selector inputs 70, such as knobs, buttons, touchscreen interfaces, etc., may be provided or mounted on a cabinet 12 (e.g., on a backsplash 71 of the cabinet 12) and are in operable communication (e.g., electrically coupled or coupled through a wireless network band) with a processing device or controller 100. A display 56 may also be provided on the backsplash 71 and may also be in operable communication with the controller 100. Controller 100 may also be provided in operable communication with motor 31, air handler 48, and/or heating assembly 40. In turn, signals generated in controller 100 direct operation of motor 31, air handler 48, and/or heating assembly 40 in response to the position of inputs 70. In the example illustrated in FIG. 2, the inputs 70 are provided as knobs. In other embodiments, inputs 70 may also or instead include buttons, switches, touchpads and/or a touch screen type interface.

Controller 100 is a "processing device" or "controller" and may be embodied as described herein. As used herein, "processing device" or "controller" may refer to one or more microprocessors, microcontrollers, application-specific integrated circuits (ASICS), or semiconductor devices and is not restricted necessarily to a single element. The controller 100 may be programmed to operate dryer appliance 10 by executing instructions stored in memory (e.g., non-transitory media). The controller 100 may include, or be associated with, one or more memory elements such as RAM, ROM, or electrically erasable, programmable read only memory (EEPROM). For example, the instructions may be software or any set of instructions that when executed by the processing device, cause the processing device to perform operations. Controller 100 may include one or more processor(s) and associated memory device(s) configured to perform a variety of computer-implemented functions and/or instructions (e.g. performing the methods, steps, calculations and the like and storing relevant data as disclosed herein). It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In some exemplary embodiments, the dryer appliance 10 may include one or more temperature sensors, such as inlet temperature sensor 43 and/or outlet temperature sensor 47. The temperature sensor(s) may be in operative communication with the controller 100. For example, in various embodiments, the controller 100 may be operable to detect, measure, and/or monitor one or more temperatures within the dryer appliance 10. Such temperatures which may be detected, measured, and/or monitored include, for example, an inlet temperature measured with the inlet temperature sensor 43 and/or an outlet temperature measured with the outlet temperature sensor 47. The temperature sensors 43 and 47 may be, in some embodiments, thermistors.

Figure 3:
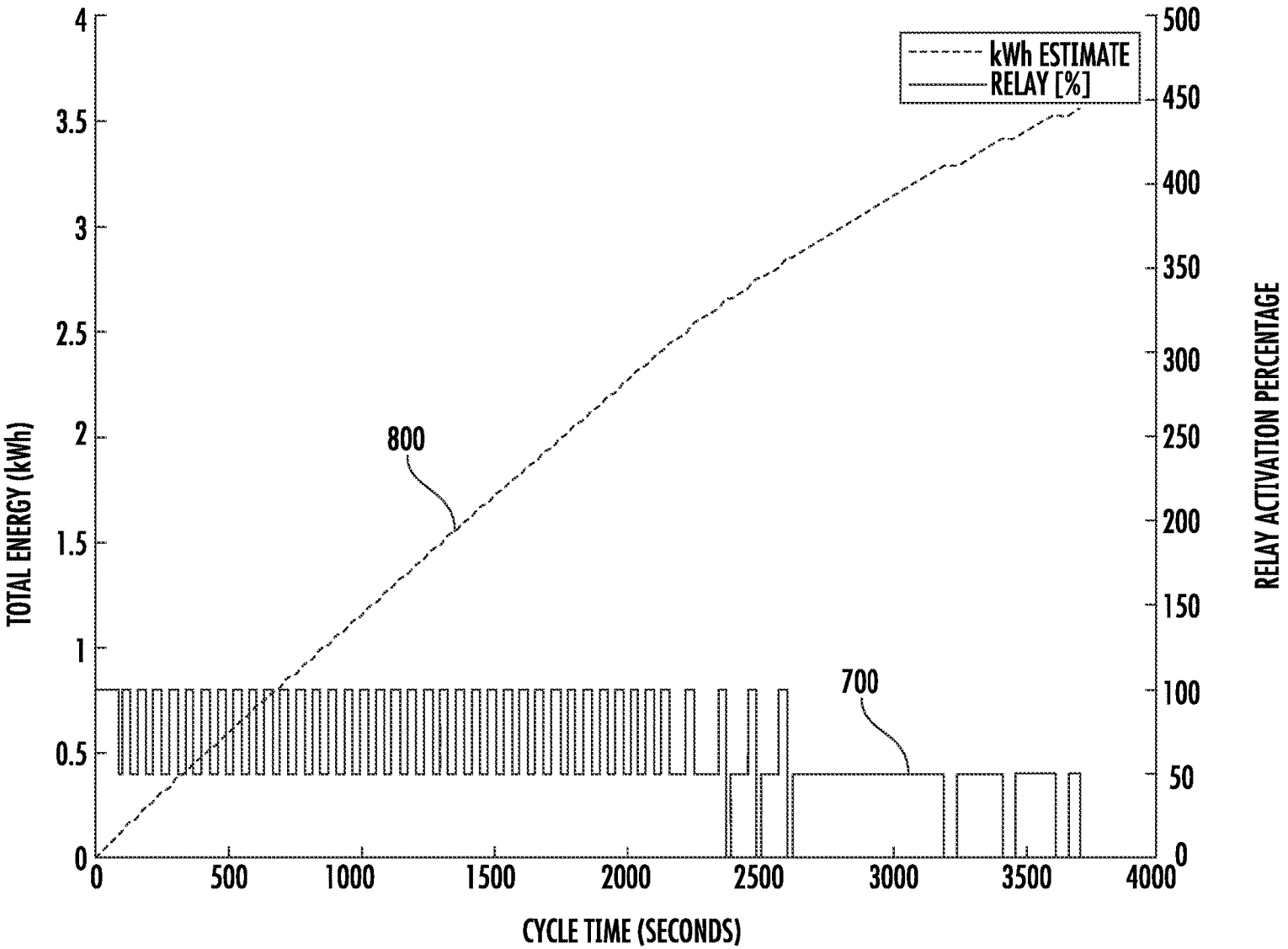
FIG. 3 provides a graph of energy output over time during an exemplary dry cycle of a dryer appliance.

FIG. 3 provides a graph of cumulative total energy supplied to a load of articles in a dryer appliance, such as the exemplary dryer appliance 10 of FIGS. 1 and 2. The example dryer appliance of which a dry cycle is illustrated in FIG. 3 includes two heating elements in the heating system, and the operation of the heating elements is simplified to either fully on or off, e.g., when neither heating element is activated the relay activation percentage is zero, when one heating element is activated the relay activation percentage is fifty, and when both heating elements are activated the relay activation percentage is one hundred. In particular, one of two heating elements being activated at full power equals fifty percent, and both heating elements being activated each at full power equals one hundred percent for the heating system as a whole. In other embodiments, the heating system may be operable over a wider range of percentages, such as (up to and including) infinitely variable between zero percent and one hundred percent. For example, the heating system may include any number of heating elements, and the heating element or elements may be operable over a more variable range, such as with a solid state relay, whereby the heating element(s) may be operable at any level (percentage) between and including zero percent and one hundred percent. Thus, the exemplary line 700 in FIG. 3 which represents power level, e.g., relay activation percentage, increments in steps between zero, fifty, and one hundred percent, but such discrete increments are by way of example only and for purposes of simplicity. Further, line 700 tracks the on time and off time, e.g., the duty cycle, of the heating system throughout the dry cycle. FIG. 3 also includes a line 800 which represents the cumulative total energy supplied to the load of articles in the dryer over the course of the cycle, e.g., in kilowatt-hours (kWh).

Figure 4:
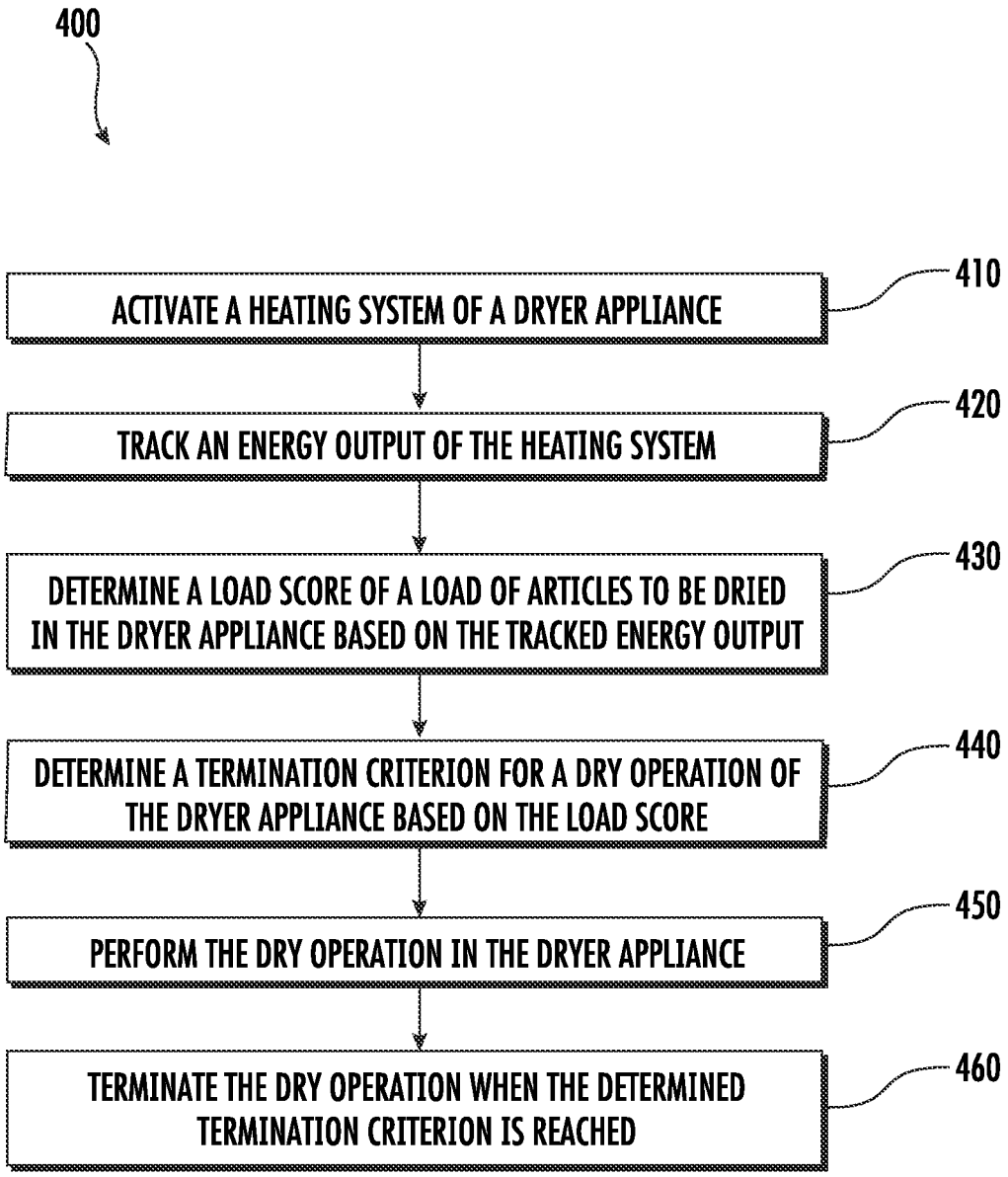
FIG. 4 provides a flow chart of an exemplary method of operating a dryer appliance according to one or more embodiments of the present disclosure.

Turning now to FIG. 4, exemplary embodiments of the present disclosure also include methods of operating a dryer appliance, where the dryer appliance may be, but is not limited to, the exemplary dryer appliance 10 of FIGS. 1 and 2. In particular, FIG. 4 illustrates a flow chart of an exemplary method 400 of operating a dryer appliance.

As shown in FIG. 4, the exemplary method 400 may include a step 410 of activating a heating system of the dryer appliance. For example, the heating system may be activated according to a predetermined startup routine, such as prior to a user-selected dry cycle of the dryer appliance. The step 410 may include activating the heating system of the dryer appliance at various power levels, e.g., percentages, such as those described above and illustrated in FIG. 3, during and throughout the startup routine. Further, in some embodiments, the startup routine may be performed for a predetermined amount of time, such as a startup time, e.g., step 410 may include activating the heating system for the startup time. In various embodiments, the startup time may be about fifteen minutes or less, such as about ten minutes or less, such as about five minutes or less, such as about two minutes or less.

Method 400 may also include a step 420 of tracking an energy output of the heating system. The energy output may be tracked, e.g., as described above with reference to FIG. 3, and in particular to line 800 in FIG. 3. In some embodiments, the energy output may be tracked as part of the startup routine, e.g., during the startup time.

As illustrated in FIG. 4, method 400 may further includes a step 430 of determining a load score of a load of articles to be dried in the dryer appliance based on the tracked energy output. The load score may correspond to or reflect a load type and/or load size of the load of articles in the dryer appliance, and may also be representative of installation conditions of the dryer appliance, such as airflow rate, which may influence the moisture removal (drying) rate of the load of articles in the dryer appliance. The load type may, for example, include a fabric type or composition of the articles in the load of articles, such as natural fibers, e.g., cotton, or synthetic fibers, e.g., polyester, etc. The load size may generally include the mass of the load of articles, such as in pounds or kilograms.

In some embodiments, the load score may also be based on a temperature rise. For example, the temperature rise may be measured at an outlet from a drum of the dryer appliance, such as with outlet temperature sensor, e.g., thermistor, 47 (FIG. 2) described above. In particular embodiments, the rate of temperature rise relative to the energy provided to the drum may be a function of and/or proportional to a thermal mass of the load of articles in the drum, such that the load score based on the energy output from the heating system and the resultant temperature rise may be reflective of the size, type, and/or remaining moisture content of the load of articles, where each of the foregoing characteristics of the load of articles may influence the thermal mass thereof. Additionally, in some embodiments, the temperature rise may be a smoothed temperature rise. For example, the temperature rise may be simplified by looking only at the starting and ending temperatures during the startup routine, or by using any suitable number of discrete temperatures during the startup routine, rather than continuously monitored instantaneous temperature values throughout the startup routine. For example, the temperature rise may be smoothed over a predefined time interval, such as about sixty seconds, such as about ninety seconds, such as about one hundred seconds.

In some embodiments, the load score may be used to inform an estimated completion of a dry operation in the dryer appliance. Thus, in some exemplary embodiments, method 400 may also include a step 440 of determining a termination criterion for a dry operation of the dryer appliance based on the load score. For example, the termination criterion may be an estimated total energy required to dry the load of articles based on the load score, and the termination criterion for the dry operation may be a total energy output, where the total energy output during the dry cycle may be tracked similarly to as described above regarding the startup time and/or with reference to FIG. 3. In additional embodiments, the termination criterion may also or instead include a sensor dry setpoint. For example, the sensor dry setpoint may be a humidity level or moisture content of exhaust from the drum, e.g., measured by a sensor at the outlet similar to the outlet temperature sensor described above. Also by way of example, the sensor dry setpoint may also or instead include a temperature level which may be measured by one or both of the inlet temperature sensor and the outlet temperature sensor. In another example, the sensor dry setpoint may also or instead include a moisture content or moisture level sensed by moisture sensing rods.

After the startup routine, e.g., after the load score has been determined and the termination criterion derived therefrom, the method 400 may then include performing the dry operation for which the termination criterion was determined, which may be a user-selected dry cycle, such as the termination criterion may be determined in order to achieve a user-selected level of dryness for the dry cycle, e.g., as illustrated at step 450 in FIG. 4. Also, as illustrated at 460 in FIG. 4, the dry cycle may then be terminated when the determined termination criterion is reached.

In some embodiments, determining the termination criterion may include comparing the load score to a threshold. In such embodiments, determining the termination criterion may further include applying a first termination criterion when the load score is less than the threshold and applying second termination criterion different from the first termination criterion when the load score is greater than the threshold. In various embodiments, multiple thresholds and a corresponding number of different termination criteria may be used.

In some embodiments, tracking the energy output may include tracking a nominal power of the heating system and a duty cycle of the heating system. For example, tracking the energy output may include tracking at what power level, e.g., percentage, the heating system is activated. The power level, e.g., percentage, may be multiplied by the nominal power (e.g., in kilowatts) of the heating system. Tracking the energy output may also include tracking for how long the heating system is on (e.g., the duty cycle of the heating system).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dryer appliance, the dryer appliance comprising a cabinet, a drum rotatably mounted within the cabinet, the drum defining a chamber for the receipt of articles for drying, and a heating system fluidly coupled to the drum whereby heated air flows from the heating system to the chamber of the drum for drying of articles within the chamber, the method comprising:

activating the heating system of the dryer appliance;

tracking an energy output of the heating system;

determining a load score of a load of articles to be dried in the drum of the dryer appliance based on the tracked energy output;

determining a termination criterion for a dry operation of the dryer appliance based on the load score;

performing the dry operation in the dryer appliance; and terminating the dry operation when the determined termination criterion is reached.

2. The method of claim 1, wherein the heating system is activated for a startup time, and the energy output is tracked during the startup time.

3. The method of claim 2, wherein the startup time is about five minutes.

4. The method of claim 1, wherein the step of determining the load score is also based on a temperature rise.

5. The method of claim 4, wherein the temperature rise is measured at an outlet from a drum of the dryer appliance.

6. The method of claim 4, wherein the temperature rise is smoothed temperature rise.

7. The method of claim 1, wherein determining the termination criterion comprises applying a first termination criterion when the load score is less than a threshold and applying second termination criterion different from the first termination criterion when the load score is greater than the threshold.

8. The method of claim 1, wherein tracking the energy output comprises tracking a nominal power of the heating system and a duty cycle of the heating system.

9. The method of claim 1, wherein the determined termination criterion is a sensor dry setpoint.

10. A dryer appliance comprising:

a cabinet;

a drum rotatably mounted within the cabinet, the drum defining a chamber for the receipt of articles for drying;

a heating system fluidly coupled to the drum whereby heated air flows from the heating system to the chamber of the drum for drying of articles within the chamber; and a controller, the controller configured for:

activating the heating system of the dryer appliance;

tracking an energy output of the heating system;

determining a load score of a load of articles to be dried in the dryer appliance based on the tracked energy output;

determining a termination criterion for a dry operation of the dryer appliance based on the load score;

performing the dry operation in the dryer appliance; and terminating the dry operation when the determined termination criterion is reached.

11. The dryer appliance of claim 10, wherein the controller is configured for activating the heating system for a startup time, and for tracking the energy output during the startup time.

12. The dryer appliance of claim 11, wherein the startup time is about five minutes.

13. The dryer appliance of claim 10, wherein the step of determining the load score is also based on a temperature rise.

14. The dryer appliance of claim 13, wherein the temperature rise is measured at an outlet from a drum of the dryer appliance.

15. The dryer appliance method of claim 13, wherein the temperature rise is smoothed temperature rise.

16. The dryer appliance of claim 10, wherein determining the termination criterion comprises applying a first termination criterion when the load score is less than a threshold and applying second termination criterion different from the first termination criterion when the load score is greater than the threshold.

17. The dryer appliance of claim 10, wherein tracking the energy output comprises tracking a nominal power of the heating system and a duty cycle of the heating system.

18. The dryer appliance of claim 10, wherein the determined termination criterion is a sensor dry setpoint.

* * * * *